United States Patent [19]

Gilissen et al.

[11] Patent Number: 4,828,503

[45] Date of Patent: May 9, 1989

[54] PRINTED CIRCUIT BOARD CONNECTOR

[75] Inventors: Hermanus P. J. Gilissen, Esch; Lucas G. C. Teurlings, 's-Hertogenbosch; Antonius P. H. M. van Laarhoven, Je Eindhoven, all of Netherlands

[73] Assignee: AMP Incorporated, Harrisburg, Pa.

[21] Appl. No.: 262,156

[22] Filed: Oct. 17, 1988

Related U.S. Application Data

[63] Continuation of Ser. No. 74,388, Jul. 16, 1987, abandoned.

[51] Int. Cl.[4] ..... H01R 9/09

[52] U.S. Cl. ..... 439/62; 439/82

[58] Field of Search ..... 439/62, 59, 76, 78, 439/82, 325, 326, 329, 547, 603, 629, 876

[56] References Cited

U.S. PATENT DOCUMENTS

| | | | |
|---|---|---|---|
| 3,796,986 | 3/1974 | Tamburro | 339/92 M |
| 4,066,326 | 1/1978 | Lovendusky | 339/221 M |
| 4,186,982 | 2/1980 | Cobaugh et al. | 439/82 |
| B1 4,186,982 | 7/1986 | Cobaugh et al. | 339/17 C |
| 4,206,964 | 6/1980 | Olsson | 339/221 M |
| 4,274,699 | 6/1981 | Keim | 339/176 MP |
| 4,461,522 | 7/1984 | Bakermans et al. | 439/62 |
| 4,533,204 | 8/1985 | Moynagh, Jr. et al. | 339/221 R |
| 4,655,537 | 4/1987 | Andrews, Jr. | 439/82 |
| 4,740,166 | 4/1988 | Barnhouse | 439/82 |
| 4,743,081 | 5/1988 | Cobaugh | 439/82 |

FOREIGN PATENT DOCUMENTS

| | | |
|---|---|---|
| 0087126 | 2/1983 | European Pat. Off. . |
| 0095282 | 11/1983 | European Pat. Off. . |

OTHER PUBLICATIONS

Product Specification—AMP, Inc.—#108(A)-90-56—4-07-81.

Product Specification—AMP, Inc.—#108-9066—5-1-9-86.

Product Specification—AMP, Inc.—#108-9067—12-04-86.

Product Specification—AMP, Inc.—#108-16—5-0-8-87.

Product Specification—AMP, Inc.—#108-260-03—Rev. E.

AMP Handbook—HB 5612, P205-78, P220, 79.

*Primary Examiner*—P. Austin Bradley

*Attorney, Agent, or Firm*—Robert J. Usher; Bruce J. Wolstoncroft

[57] ABSTRACT

A printed circuit board connector (11) comprises a housing (12) with terminals (13,111) each having a mating portion (34); an anchoring post (32,112) with a compliant portion (33,113); and a resilient contact (35,55) trapped against the surface of a printed circuit board (37) by receipt of the compliant portion (33,113) in an unplanted through-hole (36). The compliant portion (33,113) may comprise a strip-form post (112) split to form limbs (115,115') which have been pushed out in opposite directions, relatively away from each other, parallel to the plane of the slit (123) to lie in adjacent parallel planes and subsequently pushed relatively towards each other across the plane of the slit (123) to bring portions of their oppositely facing rolled surfaces adjacent the slit (123) into partially overlapping face-to-face engagement. Remote edge portions (118,118') of the respective limbs (115,115') are engageable with the internal periphery of a through-hole during insertion therein to force the limbs (115,115') further together with progressive sliding engagement of the rolled surfaces across each other further into overlapping engagement.

8 Claims, 5 Drawing Sheets

PRINTED CIRCUIT BOARD CONNECTOR

This application is a continuation of application Ser. No. 074,388 filed July 16, 1987, now abandoned.

The invention relates to electrical connectors for mounting on the faces of printed circuit boards and, in particular, to electrical connectors of the type in which the electrical connection is established directly between contact portions of the connectors and the surfaces of conductive paths on the board surface.

Certain connectors of the above-noted type are commonly known as surface mount connectors. Connection by the surface mount technique is becoming increasingly important as it enables a much higher utilisation of available board space than techniques relying on the use of plated through-holes. However, conventional surface mount techniques often require extensive preparation of the printed circuit board including the use of special plating of the conductive pads, the use of sticky paste-like solder to retain the connector located on the board prior to a curing or reflow process, and frequently a multilayer board construction. In addition, the resulting connection may be generally mechanically weaker than conventionally soldered joints, particularly than those obtained by the use of plated through-hole techniques.

Accordingly, where a pluggable connector, such as a pin or socket header, is required to be mounted on the board, either a plated through-hole connection or an additional mechanical fastening such as a conventional screw fastening may be required for the housing to withstand the mating forces.

Both approaches are disadvantageous in that considerable interruption of board geometry is required with plated through-holes, a particular difficulty with multilayer boards, while the assembly of screw fastenings on a printed circuit board is time-consuming and not entirely suitable for simple automated or robotic techniques. In addition, the provision of screw fastenings on the housing at remote anchoring points may localise the stress either requiring a housing of increased size and strength, in consequence increasing also material cost, or resulting in undesirable flexure of the housing during mating with consequential terminal movement and fracture of the solder joints.

Briefly stated, in a connector according to one aspect of the invention, a terminal having a mating portion and an anchoring post with a compliant portion traps a resilient contact against a surface of a printed circuit board by receipt of the compliant portion as a force fit in an unplated through-hole in the printed circuit board thereby electrically to connect a conductive path thereon the mating portion.

The compliant portion provides the mechanical anchoring sufficient to withstand mating and unmating forces while the resilient contact provides the electrical contact force substantially independently of the mechanical anchoring and flexes to accommodate any small connector movement arising during normal mating and other tolerances such as insertion depth.

It will be understood that the mating portion may be either male or female, and the resilient contact may be trapped either by direct engagement with the housing of the connector or the terminal.

More specifically, a printed circuit board connector comprises an insulating housing having a mating face and a board adjacent engaging face, and a compartment opening to the board engaging face, a plurality of stamped and formed terminals mounted in the housing, each with a body portion, a mating portion integrally joined to the body portion and located at the mating face, and an anchoring post integrally joined to the body portion and extending from the board engaging face, the anchoring post including a compliant portion receivable in a through-hole in a printed circuit board as a force fit. A resilient contact is located in the compartment and an arm integrally joined at one end to the body portion extends transversely of the anchoring post into the compartment, the arrangement being such that the arm urges the contact against the surface of the printed circuit board thereby to connect electrically a conductive path thereon to the mating portion.

Preferably, the contact is integrally joined to the other end of the arm and includes a contact limb extending generally transversely of the mating face carrying at one end a contact edge portion and joined at the other to a spring portion arranged to produce both translational and pivotal movement in the contact edge when engaging a conductive path during insertion movement of the compliant portion into the through-hole.

This results in a desirable board wiping action.

In one example, the housing is formed with a compartment opening to the board adjacent face, having opposite side walls and first and second end walls, the first end wall defining a face of the housing adjacent and extending away from the board adjacent face, a slot extending along the first end wall away from the board adjacent face, the movement bringing the contact edge into the slot.

This both exposes the final connection for inspection and maximizes the use of the housing width.

Preferably, the arrangement is such that the movement of the contact edge is away from the anchoring post, maximizing the separation of the final connection point and the through-holes, thereby minimizing the risk of damage to the conductive paths by fracture or distortion of the through-holes during insertion of the compliant portion therein.

The body portion of the terminal is mounted in a second compartment formed in the housing on a side of the second end wall remote from the first compartment and, in another example, the second end wall is formed with a slot extending away from the mating face, the movement bringing the contact edge towards the body portion into the slot.

This other example provides the advantage that the final connection is adjacent the anchoring post and is therefore less sensitive to movement of the connector on mating.

In a preferred construction, the spring portion is of sinuous shape comprising first and second, oppositely directed, open loops adjoining the arm and contact limb, respectively, the movement of the contact limb being accompanied by expansion and contraction of the first and second loops, respectively.

The first and second compartments comprise through-slots extending in coplanar relation between oppositely directed mating and board adjacent faces of the housing, and the terminal is substantially uniplanar, a series of sets of first and second compartments and terminals being arranged in the housing with first and second compartments of adjacent sets being located in opposite senses with the first and second compartments of the one set being adjacent the second and first compartments, respectively, of an adjacent set, the mating portions of adjacent terminals being bent to overlie the housing side wall between their associated compartments and into mutually aligned pairs.

An example of a terminal having a compliant portion which may be used in the connector is described in U.S. Pat. No. 4,186,982 and comprises a post split longitudinally by shearing to form two limbs which have been pushed out in opposite directions parallel to the shear plane. When forced into a through-hole in a circuit board, the limbs are forced back together by the hole edges with progressive mutual sliding engagement of the sheared surfaces further into overlapping engagement.

Terminals having compliant portions as described above have a very high retention force which is desirable when, for example, connection is to be made to the post subsequently by a wire wrapping technique.

However, for this application, the very high retention force for subsequent wire wrapping is not necessary and the associated disadvantages such as a high insertion force and the problem of distortion of the through-holes together with the manufacturing difficulties arising as a result of the close tolerances to be maintained should be avoided.

In addition, as a result of the requirement for sliding engagement of the sheared surfaces, the stock must be relatively thick, contributing to the problems and expense of manufacture.

According to one aspect of the invention, a portion of a post of increased width is split longitudinally to form two limbs which have been pushed out in opposite directions, relatively away from each other, parallel to the plane of the slit (perpendicular to the plane of the increased width portion) to lie in adjacent parallel planes and subsequently pushed relatively towards each other across the plane of the slit to bring portions of their oppositely facing rolled surfaces adjacent the slit into partially overlapping face-to-face engagement, remote edge portions of the respective limbs being engageable with the internal periphery of a through-hole of a circuit board during insertion therein to force the limbs further together with progressive sliding engagement of the rolled surface portions across each other further into overlapping engagement.

The resulting insertion forces may be lower than with the prior version as the rolled surfaces have a lower coefficient of friction resisting movement of the limbs together during insertion than the sheared surfaces which are relatively rough, thereby reducing the risk of damage to through-holes. In addition, the post may be relatively thin, essentially of strip form, permitting more economic manufacture. For example, the compliant portion of the terminal may be made from stock of the same thickness (10 mil.) as that commonly used for a printed circuit board contact portion, avoiding a need for expensive premilled dual thickness stock often required with the prior version.

The remote edges extend in mutually parallel relation offset in laterally opposite directions from a longitudinal medial axis of the post and are joined to an insertion end of the post by mutually divergent lead-in edge portions.

Examples of electrical connectors according to the invention will now be described with reference to the accompanying drawings in which.

Figure 7:
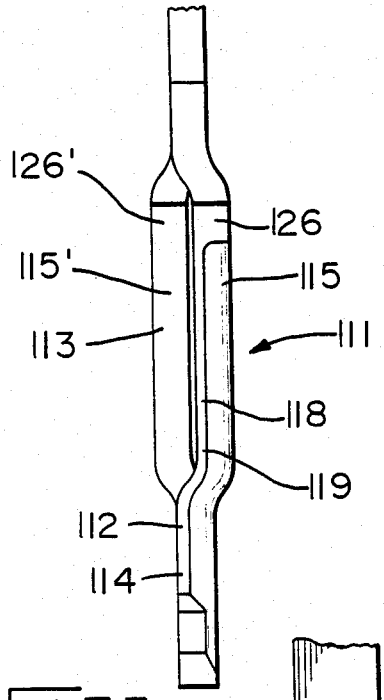
FIG. 7 is a side elevation of a suitable low insertion force compliant portion of a terminal for the connector.
Figure 8A:
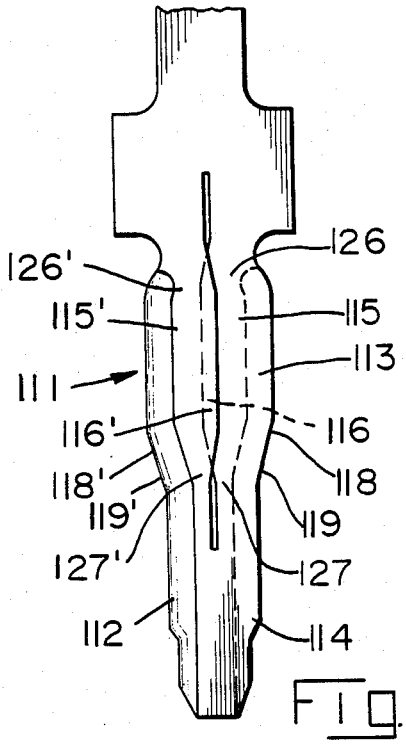
Figure 8B:
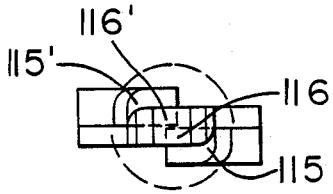
Figure 9A:
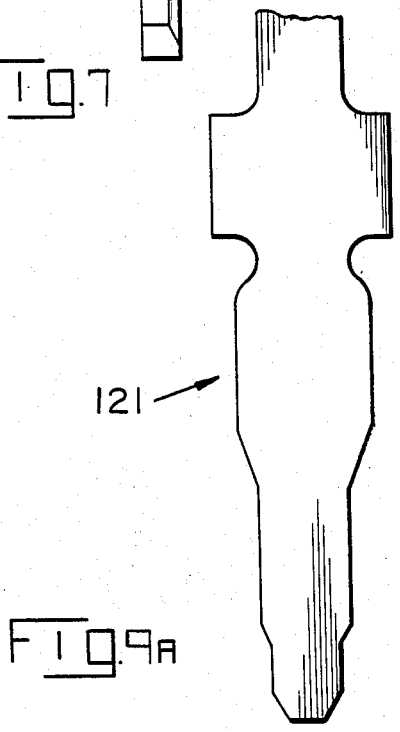
Figure 9B:
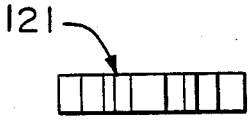

FIGS. 8*a* and 8*b* are a front elevation and underplan, respectively, of the compliant portion of FIG. 7; and FIGS. 9*a* and 9*b* to FIGS. 11*a* and 11*b* are front elevationals and underplans showing successive stages of manufacture of the compliant portion.

Figure 2:
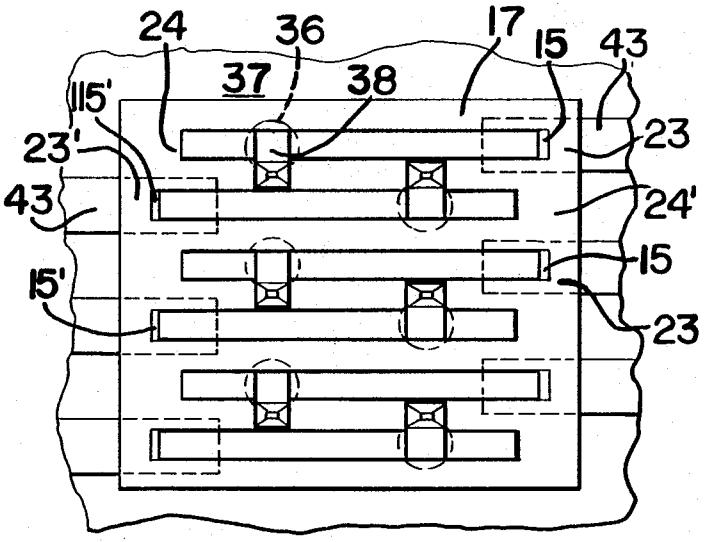
FIG. 2 is a plan view of the pin header mounted on the printed circuit board.
Figure 1:
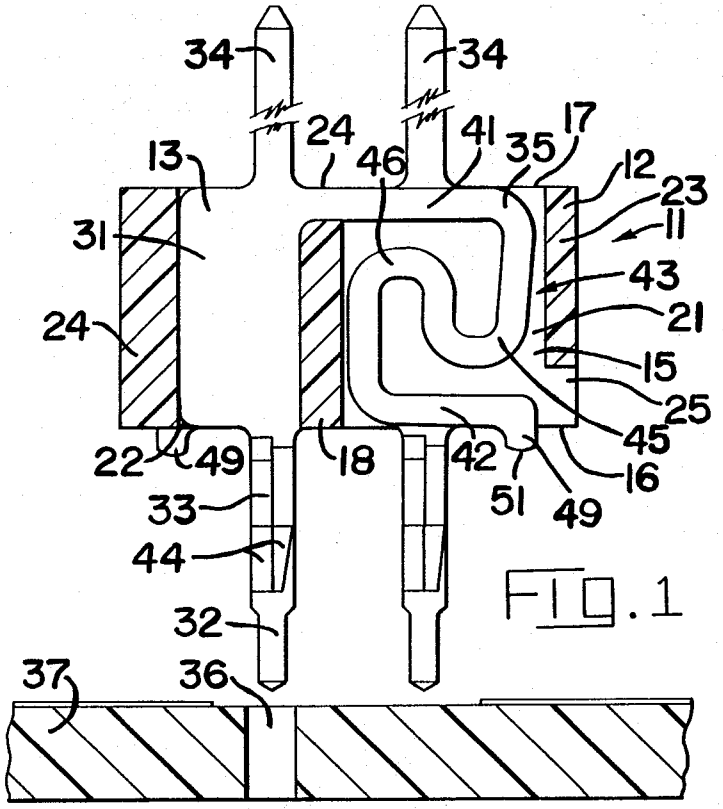
FIG. 1 is a cross-sectional view of a first example of a pin header according to the invention aligned with a printed circuit board.
Figure 3:
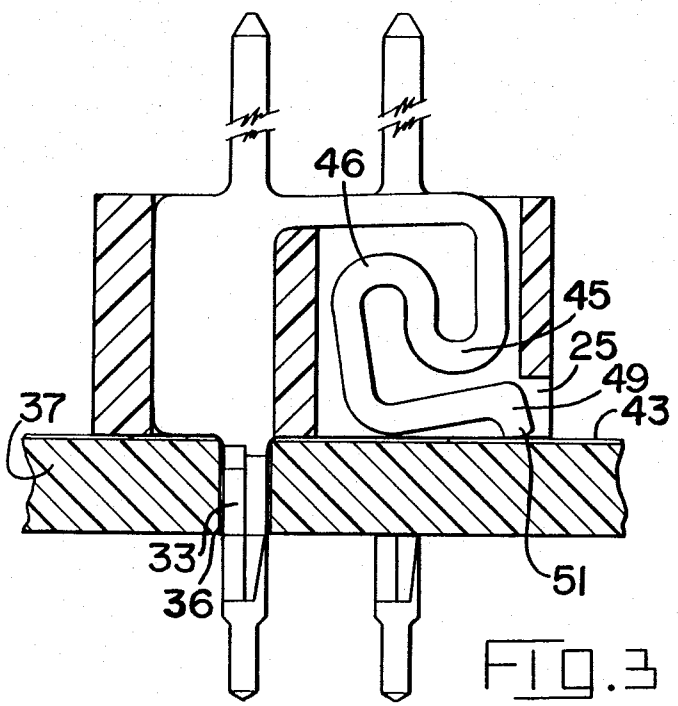
FIG. 3 is a cross-sectional view of the pin header mounted on the printed circuit board.

As shown in FIGS. 1 to 3, the first example of pin header 11 comprises an insulating housing 12 in which are mounted a series of identical terminals 13.

The housing 12 is moulded as a one-piece body of plastics material, rectangular in section and plan, and formed with a series of first and second terminal-receiving through-slots 15,15' located in spaced-apart parallel relation along its length which communicate with opposite board-engaging and mating faces of the housing, 16 and 17 respectively. Each through-slot 15 or 15' is divided by an internal partition 18 or 18' extending from the board mounting face part way towards the mating face 17 into first and second compartments 21 or 21' and 22 or 22, respectively, which intercommunicate adjacent the mating face.

The first compartments 21 or 21' are larger than the second compartments 22 or 22', and the first and second compartments of adjacent through-slots 15 and 15' are arranged in opposite senses, i.e. rotated through 180 degrees. As shown particularly in FIG. 2, adjacent through-slots 15,15' are also located in staggered relation with first and second slots alternating so that all first slots 15 are in mutual alignment and all second slots 15' are in mutual alignment. As a result of the staggered disposition of the adjacent slots, a first end wall portion 23 or 23' of each slot is less thick than a second end wall portion 24 or 24'. A clearance slot or notch 25 or 25' opening to the board mounting face 16 is formed in each first end wall portion 23 so that opposite sides of the board engaging face 16 have a castellated appearance.

Each terminal 13 is stamped and formed in one piece from sheet metal stock and includes a planar rectangular body portion 31 from respective opposite ends of which, at locations near adjacent corners, extend a post 32 formed with a compliant board anchoring portion 33, an oppositely directed mating pin34 substantially in mutual alignment, and a board connecting portion 35 extending from one side of the body portion 31.

The compliant portion 33 is of known type, for example, as described in U.S. Pat. No. 4,186,982, incorporated herein, and made by splitting the post by shearing to form a pair of beam spring arms 44 pushed out in opposite directions for reception in a through-hole 36 in a printed circuit board 37 as a force fit, opposite sheared surfaces of the arms 44 being in sliding engagement during insertion.

The mating pins 34 have root ends 38 bent out of the plane of the body portion 31 so that pins 34 of adjacent terminals 13 project from the mating face 17 located in precise transverse alignment over a wall between adjacent through-slots 15 or 15' when assembled in the housing 12.

The board connecting portion 35 of the terminal 13 comprises first and second cantilever elements 41,42 respectively located in substantially parallel relation by being integrally joined at first remote ends by a sinuous spring 43 comprising in effect first and second, oppositely directed, open loops or bights 45 and 46 respectively, constituted by beam elements which are rectilinear to increase their effective length. The first cantilever element 41 extends at a second end from a side of body portion 31 at a location adjacent the mating pin 34 perpendicularly away therefrom between the partition 18 and the mating face 17 across a major portion of the first compartment 21 adjacent the mating face 17 but terminating free of the end wall 23. The second cantilever element 42 extends adjacent the board engaging face with the first end adjacent the partition 18 and the free end adjacent the notch 16. The free end carries a contact foot 49 having an arcuate contact edge 51 which protrudes beyond the board engaging face 16 prior to mounting the connector 11 on the printed circuit board 37.

In assembling the connector 11, the terminals are inserted one-by-one through the mating face 17 into the through-slots 15 and 15', the compliant portions 34 passing along clearance grooves (not shown) located in opposed relation in opposite sidewalls of compartment 22.

When fully assembled, the root end of the first cantilever arm 41 seats on the partition 18 and the contact foot 49 protrudes beyond the board engaging face 16 adjacent the notch 25.

The connector 11 is mounted on the printed circuit board 37 by a direct plugging action, a major part of the insertion force being imposed on the edge of the body portion adjacent the mating pin, and the compliant portions 34 each received as a force fit in a suitably located through-hole 36 thereby to anchor the connector 11 on the board 37, as shown in FIG. 3. Movement of the connector 11 against the board 37 causes translational movement of the foot 49 along a conductive path 43 into the notch 25 with simultaneous pivotal movement providing both a wiping action and progressively presenting a different portion of the arcuate contact edge 51 against the conductive path 43. As seen by a comparison of FIGS. 1 and 3, this movement is accomplished by expansion of the first loop or bight 45 and a contraction of the second loop or bight 46 with a consequential respective decrease and increase in the clearances between the first and second loops and the end wall 23 and partition 18.

The connector 11 can therefore be securely anchored on a printed circuit board 37 and effectively connected thereto by a simple plugging action without recourse to plated through-holes or elaborate pre-plating techniques or soldering. The structure of the contact portion 43 provides both an advantageous soft spring constant force characteristic accommodating tolerances and the advantageous pivotal and wiping action ensuring a reliable electrical connection. In addition, the spring remains within the compartment in both flexed and unflexed conditions. The even spacing of the anchoring posts 32 assures an even stress distribution on the housing 12 during mating, with minimum distortion of the through-holes, and the staggering ensures a relatively massive supporting wall 24 or 24' adjacent each body portion. In addition, as the contact foot and the connection point to the printed circuit board is widely spaced from the through-holes, there is also relatively little or no risk of any distortion of a through-hole upsetting a conductive path. This also enables the use of relatively wide conductive paths. The substantial axial alignment of the mating pins and anchoring posts assure that only substantially translational forces normal to the printed circuit board and the mating face are produced during mating with very little or no turning components, thereby avoiding a need for a massive housing body.

A further advantage of the movement of the contact foot into the slot or notch 25 is that it facilitates access or inspection of the point of connection after mounting the connector on the printed circuit board.

Figure 4:
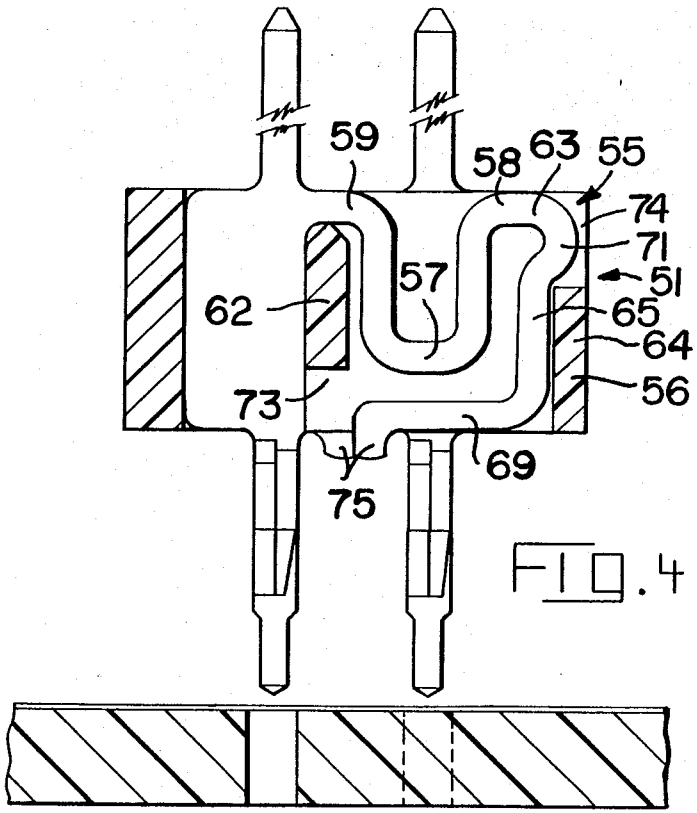
FIG. 4 is a cross-sectional view of a second example of a pin header.
Figure 6:
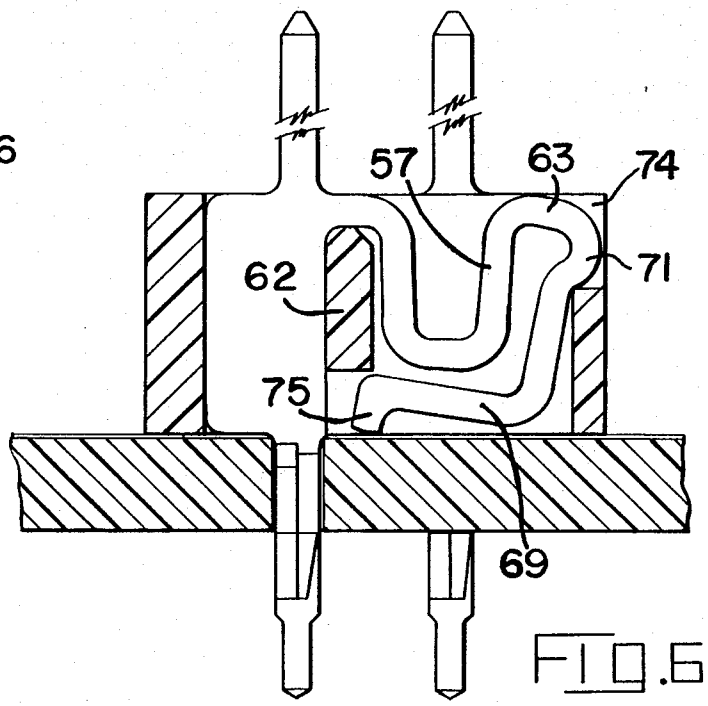
FIG. 6 is a cross-sectional view of the second example mounted on the printed circuit board.
Figure 5:
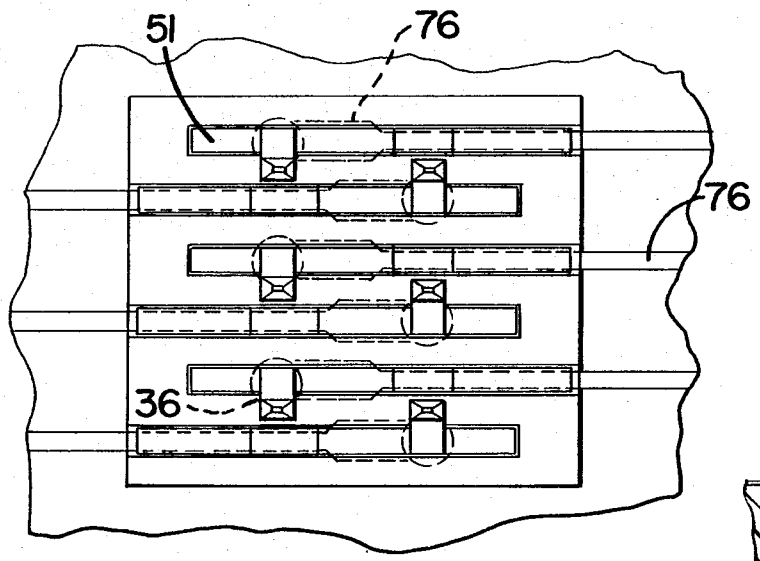
FIG. 5 is a plan view of the second example mounted on the printed circuit board.

The second example of connector 51 shown in FIGS. 4 to 6 is generally similar to the first example both in structure and function except for modification in the structure of the contact portion 55 and largely consequential modifications in the housing body 56.

In the contact portion 55, the first cantilever element 59 is relatively short and stiff so that the first loop or bight 57 of the sinuous spring 58 is adjacent the partition 62 and the second loop or bight 63 is adjacent an end wall 64. This enables the base of the second loop 63 to be adjacent the mating face and have an end element 65 extending for substantially the entire depth of the slot joined to a second cantilever element 69 which extends from the end wall 64 in an opposite direction to that of the first example to a location adjacent the partition 62. The second loop 63 is relatively narrow, being formed with a knee 71 at the root end.

The housing 12 is modified by the provision of a slot or notch 73 in the partition 62 at the board engaging face and a further slot or notch 74 at the mating face to accommodate the knee 71.

Application of the connector to the printed circuit board causes translational and pivotal movement of the foot 75 on a conductive path 76 into the slot or notch 73 again with expansion and contraction of the first and second bights respectively, as shown in FIG. 6.

An advantage of the second example is that less leverage is imposed on the point of connection with the printed circuit board as a result of movement of the connector during mating than in the first example as the connection point is adjacent the anchoring points. However, the conductive paths 76 must be relatively narrow in view of their close proximity to the anchoring posts and through-holes 36 past which they must extend.

The lower insertion force example of terminal 111, shown in FIGS. 7–11*b*, includes a strip-form post 112 stamped and formed from sheet metal stock with a medial compliant portion 113 of greater width than an insertion end portion 114. The compliant portion 113 comprises a pair of planar limbs 115 and 115' which extend side-by-side in parallel, adjacent planes and have mutually adjacent portions 116,116' located in partly overlapping relation so that opposite rolled surfaces are in face-to-face engagement. Remote edges 118,118' of the limbs 115,115' extend in parallel relation and are joined to remote edges of the insertion end portion 114 by divergent lead-in edges 119,119'. A contact portion (not shown), having a desired function such as an edge contact for a printed circuit board, is integrally joined to the end remote from the lead-in end.

Figure 10B:
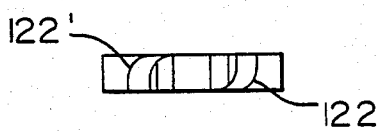
Figure 11B:
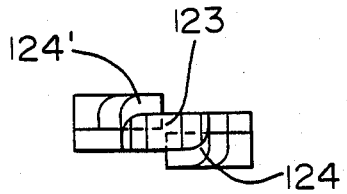
Figure 10A:
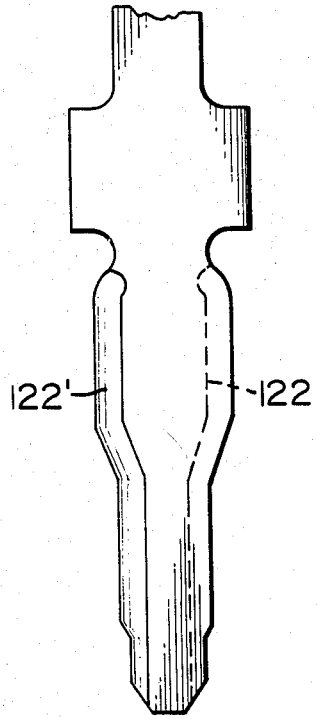
Figure 11A:
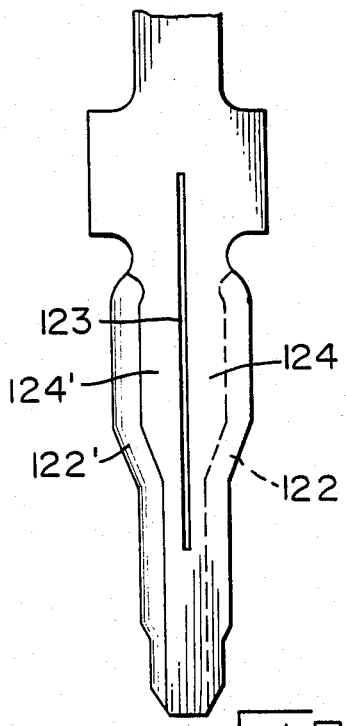

As shown in FIGS. 9*a* to 11*b*, in one method of manufacture, the compliant portion 113 is made from a strip-form blank 121 shaped as shown in FIGS. 3*a* and 3*b*, a pair of diagonally opposite edges 122,122' of which are then coined to provide smoothly radiussed surfaces as shown in FIGS. 10*a* and 10*b*. The blank is then split longitudinally by shearing along a centreline to provide a slit 123 extending completely through and beyond the medial portion 113' and precursors 124,124' of the limbs 115,115' which extend in adjacent planes on each side of the slit as shown in FIGS. 11*a* and 11*b*. The limb precursors 124,124' are then pushed towards each other in parallel planes perpendicularly of the slit 123, bringing opposite surfaces of their mutually adjacent portions 116,116' into the partially overlapping face-to-face engagement shown in FIGS. 7, 8*a* and 8*b*, such movement towards each other also imparting a degree of twist to the root ends 126,126' and 127,127' of the limbs 115,115'.

It will be appreciated that, during insertion, engagement of the divergent lead-in edges 119,119' with the plated through-hole urges the limbs 115,115' towards each other, bringing their adjacent portions 116,116' further into overlapping engagement with progressive sliding engagement of their rolled surfaces to establish a permanent connection to the printed circuit board.

The relative proportions of plastic and elastic deformation of the compliant portion during insertion depends at least in part on the length of the slit and the width of the through-hole, but when used with typical printed circuit boards of usual practical thickness which will determine the length of the slit, the deformation will be mainly plastic.

We claim:

1. An electrical terminal (13,111) stamped and formed from a single piece of sheet metal stock and comprising a body portion (31) adapted to be mounted in an insulating housing (12), from which body portion (31) extends a mating portion (34) and an anchoring post (32,112) formed with a compliant anchoring portion (33,113) adapted to be received in a through-hole (36) in a circuit board (37) as a force fit thereby to anchor the terminal (13,111) to the circuit board (37), characterized in that:

a resilient contact portion (35,55) can be trapped to extend against the surface of the printed circuit board (37) as compliant anchoring portion (33,113) is received in through-hole (36);

an arm (41) integrally joined at one end to the body portion (31) extends transversely of the anchoring post (32,112) urging the contact portion (35,55) against the surface of the printed circuit board (37);

the contact portion (35,55) is integrally joined to the other end of the arm (41) and includes a contact limb (42,59) carrying at one end a contact edge portion (51,75) and joined at the other to a spring portion (43,58) arranged to produce both translational and pivotal movement in the contact edge (31,75) when engaging a conductive path (43,76) during insertion movement of the compliant portion (33,113) into the through-hole (36).

2. An electrical terminal according to claim 1, characterized in that the compliant anchoring portion (113) comprises a portion (113) of increased width which is split longitudinally to form two limbs (115,115') which have been pushed out in opposite directions, relatively away from each other, parallel to the plane of the slit (123) to lie in adjacent parallel planes and subsequently pushed relatively towards each other across the plane of the slit (123) to bring portions (116,116') of their oppositely facing rolled surfaces adjacent the slit (123) into partially overlapping face-to-face engagement, remote edge portions (118,118') of the respective limbs (115,115') being engageable with the internal periphery of a through-hole (36) of a circuit board (37) during insertion therein to force the limbs (115,115') further together with progressive sliding engagement of the rolled surface portions (116,116') across each other further into overlapping engagement.

3. An electrical terminal comprising a metal post having a portion (113) of increased width which is split longitudinally to form two limbs (115,115') which have been pushed out in opposite directions, relatively away from each other, parallel to the plane of the slit (123) to lie in adjacent parallel planes, characterised in that the limbs (115,115') are subsequently pushed relatively towards each other across the plane of the slit (123) to bring portions (116,116') of their oppositely facing rolled surfaces adjacent the slit (123) into partially overlapping face-to-face engagement, remote edge portions (118,118') of the respective limbs (115,115') being engageable with the internal periphery of a through-hole (36) of a circuit board (37) during insertion therein to force the limbs (115,115') further together with progressive sliding engagement of the rolled surface portions (116,116') across each other further into overlapping engagement.

4. A surface mount printed circuit board connector (11) comprising an insulating housing (12) having a mating face (17) and a board adjacent face (16), and a plurality of stamped and formed terminals (13, 111) with respective body portions (31) fixed in the housing (12), mating portions (34) integrally joined to the body portions (31) located at the mating face (17) and an anchoring post (32, 112), comprising a compliant anchoring portion (33, 113) integrally joined to each body portion (31) and extending from the board adjacent face (16), characterized in that:

the connector (11) includes a resilient contact portion (35, 55) trapped to extend against the surface of the printed circuit board (37) by receipt of the compliant portion (33, 113) as a force fit in an unplated through-hole (36) in the printed circuit board (37) thereby electrically connecting a conductive path (43, 76) thereon to the mating portion (34);

an arm (41) integrally joined at one end to the body portion (31) extends transversely of the anchoring post (32, 112) urging the contact portion (35, 55) against the surface of the printed circuit board (37);

the contact portion (35, 55) is integrally joined to the other end of the arm (41) and includes a contact limb (42, 59) extending generally transversely of the mating face carrying at one end a contact edge portion (51, 75) and joined at the other to a spring portion (43, 58) arranged to produce both translational and pivotal movement in the contact edge (31, 75) when engaging a conductive path (43, 76) during insertion movement of the compliant portion (33, 113) into the through-hole (36).

5. A connector according to claim 4, characterized in that the resilient contact portion (35, 55) is of sinuous shape comprising first and second, oppositely directed, open loops (45, 56, 57, 63) adjoining the arm (41, 59) and contact limb (42, 69), respectively, the movement of the contact limb (42, 69) being accompanied by expansion and contraction of the first and second loops (45, 46, 57, 63) respectively.

6. A connector according to claim 4, characterized in that the compliant portion (113) comprises a post portion (112) of increased width which has been split longitudinally to form two limbs (115, 115') which have been pushed out in opposite directions, relatively away from each other, parallel to the plane of the slit (123) to lie in adjacent parallel planes and subsequently pushed relative towards each other across the plane of the slit (123) to bring portions (116, 116') of their oppositely facing rolled surfaces adjacent the slit (123) into partially overlapping face-to-face engagement, remote edge portions (118, 118') of the respective limbs 115, 115') being engageable with the internal periphery of a through-hole (36) of a circuit board (37) during insertion therein to force the limbs (115, 115') further together with progressive sliding engagement of the rolled surface portions (116, 116') across each other further into overlapping engagement.

7. A connector according to claim 4, characterized in that the housing (12) is formed with a compartment (21, 21') opening to the board adjacent face (16), having opposite side walls and first and second end walls (23, 18), the first end wall (23) defining a face of the housing (12) adjacent and extending away from the board adjacent face (16), a slot (25) extending along the first end wall (23) away from the board adjacent face (16), the movement bringing the contact edge (51, 75) into the slot.

8. A connector according to claim 7, characterized in that the body portion (31) of the terminal (13, 111) is mounted in a second compartment (22, 22') formed in the housing (12) on a side of the second end wall (18, 62) remote from the first compartment (21, 21'), the first and second compartments (21, 21'; 22, 22') comprising through-slots (15, 15') extending in coplanar relation between oppositely directed mating and board adjacent faces (17, 16) of the housing (12) and the terminal (13) is substantially uniplanar, a series of sets of first and second compartments (21, 21'; 22, 22') and terminals (13, 111) being arranged in the housing (12) with first and second compartments (21, 22; 21', 22') of adjacent sets being located in opposite senses with the first and second compartments (21, 22) of the one set being adjacent the second and first compartments (22', 21'), respectively, of an adjacent set, the mating portions (34) of adjacent terminals (13, 111) being bent to overlie the housing side wall between their associated compartments (22, 22') to provide mutually aligned pairs.

* * * * *